US008736514B2

(12) United States Patent
Nakabayashi et al.

(10) Patent No.: US 8,736,514 B2
(45) Date of Patent: May 27, 2014

(54) ANTENNA

(75) Inventors: Kento Nakabayashi, Anjo (JP); Shin-ichiro Matsuzawa, Nisshin (JP); Masaru Ogawa, Seto (JP)

(73) Assignee: Denso Corporation, Kariya (JP)

( * ) Notice: Subject to any disclaimer, the term of this patent is extended or adjusted under 35 U.S.C. 154(b) by 479 days.

(21) Appl. No.: 13/068,209

(22) Filed: May 5, 2011

(65) Prior Publication Data

US 2012/0229364 A1 Sep. 13, 2012

(30) Foreign Application Priority Data

Mar. 9, 2011 (JP) ..... 2011-052021

(51) Int. Cl.
*H01Q 1/00* (2006.01)

(52) U.S. Cl.
USPC ..... 343/905; 343/785; 343/911 R; 343/893

(58) Field of Classification Search
USPC ..... 343/905, 785, 911 R, 893
See application file for complete search history.

(56) References Cited

U.S. PATENT DOCUMENTS 6,424,298 B1 7/2002 Nishikawa et al.

FOREIGN PATENT DOCUMENTS

| | | |
|---|---|---|
| CN | 101841083 | 9/2010 |
| JP | 2001-044752 | 2/2001 |
| JP | 2001-111335 | 4/2001 |
| JP | 2007-081825 | 3/2007 |

OTHER PUBLICATIONS

Wang, Peter P. et al, "An Investigation of Printed Franklin Antennas at X-Band Using Artificial (Metamaterial) Phase-Shifting Lines"; IEEE Transactions on Antennas and Propagation, vol. 56, No. 10, Oct. 2008, pp. 3118-3128.

Wang, Peter P. et al, "An Investigation of Printed Franklin Antennas at K-Band Using Artificial (Metamaterial) Phase-Shifting Lines"; IEEE Transactions on Antennas and Propagation, vol. 56, No. 10, Oct. 2008, pp. 3118-3128.

Office action dated Dec. 4, 2013 in corresponding Chinese Application No. 2011 10157545.X.

*Primary Examiner* — Kristy A Haupt
(74) *Attorney, Agent, or Firm* — Harness, Dickey & Pierce, PLC

(57) ABSTRACT

The antenna includes a first ground plate, a first dielectric substrate formed on the first ground plate, a transmission line made of a conductive material formed on the first dielectric substrate, and a plurality of antenna elements electromagnetically coupled to the transmission line. The transmission line is constituted of at least one first line serving as a resonator having a resonator length equal to (2n−1)/2 times (n being a positive integer) a guide wavelength of the transmission line and a plurality of second lines each having an electrical length longer than half the guide wavelength, the first and second lines being disposed alternately at predetermined intervals. Each of the antenna elements is electromagnetically coupled to a corresponding one of the second lines.

14 Claims, 7 Drawing Sheets

ANTENNA

This application claims priority to Japanese Patent Application No. 2011-52021 filed on Mar. 9, 2011, the entire contents of which are hereby incorporated by reference.

BACKGROUND OF THE INVENTION

1. Field of the Invention

The present invention relates to an antenna whose beam direction can be steered by varying the operating frequency of the antenna.

2. Description of Related Art

Japanese Patent Application Laid-open No. 2001-44752 (Patent document 1) discloses an array antenna which is efficient in the millimeter-wave range and whose beam direction can be steered. This array antenna includes a dielectric substrate having a ground plate formed at one surface thereof and a strip line formed at the other surface, and a plurality of antenna elements disposed along the length of the strip line on both sides of the strip line. The beam direction of this array antenna can be steered by varying the operating frequency thereof. According to such a conventional series-fed array antenna, it is possible to steer the antenna beam within an angle range of 1.5 degrees by varying the operating frequency by 1 GHz. However, there is a strong demand to provide an antenna having a much wider beam scan range.

P. P. Wang, M. A. Antoniades, and G. V. Eleftheriades, IEEE Trans. Antennas and Propagation. vol. 56, No. 10, 2008 (Non-patent document 1) describes a Franklin antenna having a structure in which a phase shifter is interposed between each adjacent half-wave dipole antennas. In such a Franklin antenna, the beam angle can be adjusted depending on a phase shift amount of each phase shifter by varying the operating frequency.

Japanese Patent Application Laid-open No. 2007-81825 (Patent document 2) discloses a leaky-wave antenna having a structure in which its transmission line is provided with the so-called meta-material structures located at certain intervals, each meta-material structure including a gap serving as a capacitor and a stub serving as an inductor, so that the transmission line operates as a left-handed line within a specific frequency range. According to such a leaky-wave antenna, it is possible to steer the antenna beam vary widely by varying the operating frequency.

However, the scan angle range of the array antenna described in Patent document 1, which is about 1.5 degrees for variation of 1 GHz in the frequency range of 76-77 GHz, is not sufficient for use in a vehicle-mounted millimeter-wave radar.

The leaky-wave antenna described in Patent document 2 includes the structure in which the meta-material structures are disposed in a line at certain intervals, and the antenna elements are arranged on the meta-material structures. Accordingly, since the distance between the antenna element and the corresponding meta-material structure is small, and the electromagnetic coupling therebetween is strong, when the shape or size of each antenna elements is changed to adjust the emission intensity, the characteristic of the meta-material structure is also changed causing the antenna beam angle to change. That is, the above leaky-wave antenna has a problem in that the emission intensity from the antenna and the antenna beam angle cannot be controlled independently.

According to the Franklin antenna described in Non-patent document 1, although it is possible to adjust the antenna beam angle by adjusting the phase shift amount, the emission efficiency is low and the side lobes are not small, because it is not possible to control the emission intensity from each antenna element.

SUMMARY OF THE INVENTION

An embodiment provides an antenna comprising:

a first ground plate;

a first dielectric substrate formed on the first ground plate;

a transmission line made of a conductive material formed on the first dielectric substrate; and a plurality of antenna elements electromagnetically coupled to the transmission line;

wherein the transmission line is constituted of at least one first line serving as a resonator having a resonator length equal to $(2n-1)/2$ times (n being a positive integer) a guide wavelength of the transmission line and a plurality of second lines each having an electrical length longer than half the guide wavelength, the first and second lines being disposed alternately at predetermined intervals, and each of the antenna elements is electromagnetically coupled to a corresponding one of the second lines.

According to the present invention, there is provided an antenna whose beam angle can be steered widely, and whose beam angle and emission intensity from its antenna elements can be controlled independently.

Other advantages and features of the invention will become apparent from the following description including the drawings and claims.

PREFERRED EMBODIMENTS OF THE INVENTION

First Embodiment

Figure 1:
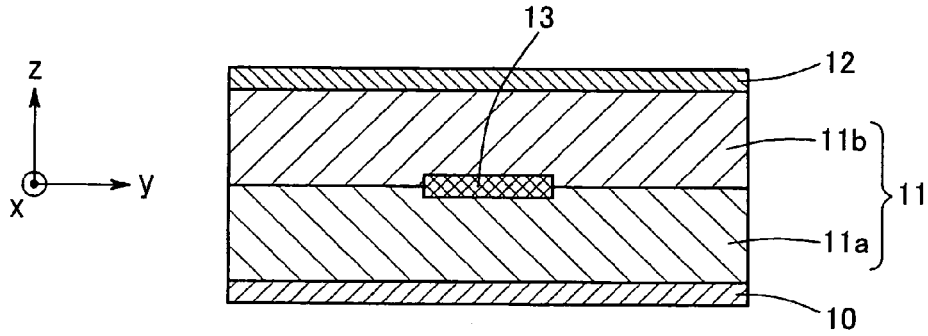
FIG. 1 is a cross-sectional view of an antenna according to a first embodiment of the invention.
Figure 2:
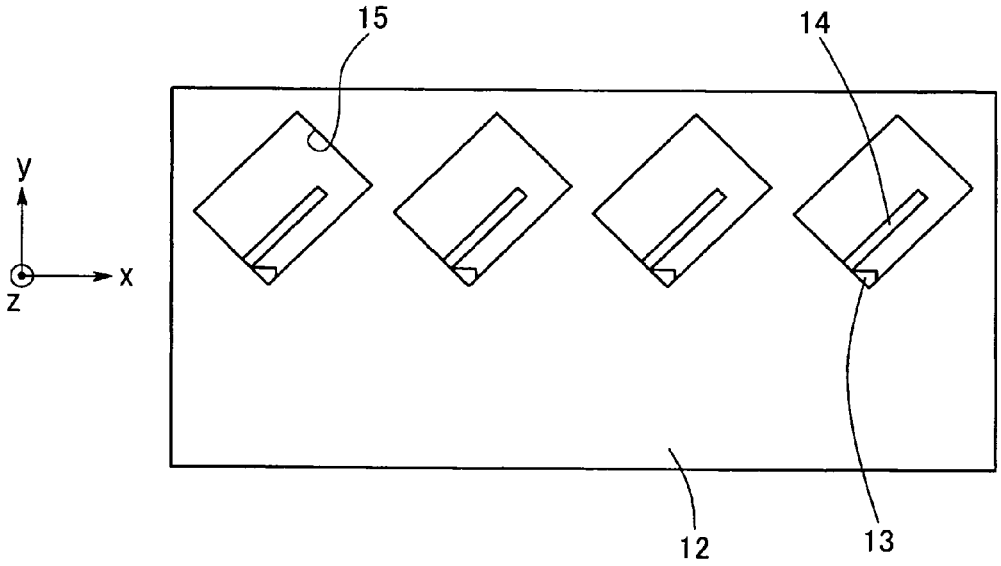
FIG. 2 is a plan view of the antenna of the first embodiment as viewed from the above.

FIG. 1 is a cross-sectional view of an antenna according to a first embodiment of the invention. FIG. 2 is a plan view of the antenna of the first embodiment as viewed from the above. The antenna of the first embodiment includes a first ground plate 10, a first dielectric substrate 11*a* formed on the first ground plate 10, a strip line 13 formed as a transmission line on the first dielectric substrate 11*a*, a second dielectric substrate 11*b* formed on the strip line 13 and the first dielectric substrate 11*a*, a second ground plate 12 formed on the second dielectric substrate 11*a*, and antenna elements 14 connected to the strip line 13. The first and second dielectric substrates 11*a* and 11*b* constitute a dielectric layer 11. The first and second dielectric substrates 11*a* and 11*b* may be made of the same dielectric material or different dielectric materials. As shown in FIG. 1, the antenna of the first embodiment is a triplate antenna in which the strip line 13 made of a conductive material is formed in the dielectric layer 11 interposed between the first ground plate 10 and the second ground plate 12. In the following description, $\lambda$ is a guide wavelength at 76.5 GHz. The guide wavelength $\lambda$ is given by the expression of $\lambda=\mu_0/(\in_r)^{1/2}$ where $\lambda_0$ is the free space wavelength which is approximately 3.9 mm at 76.5 GHz, and $\in_r$ is the relative dielectric constant of the dielectric layer 11.

Figure 3:
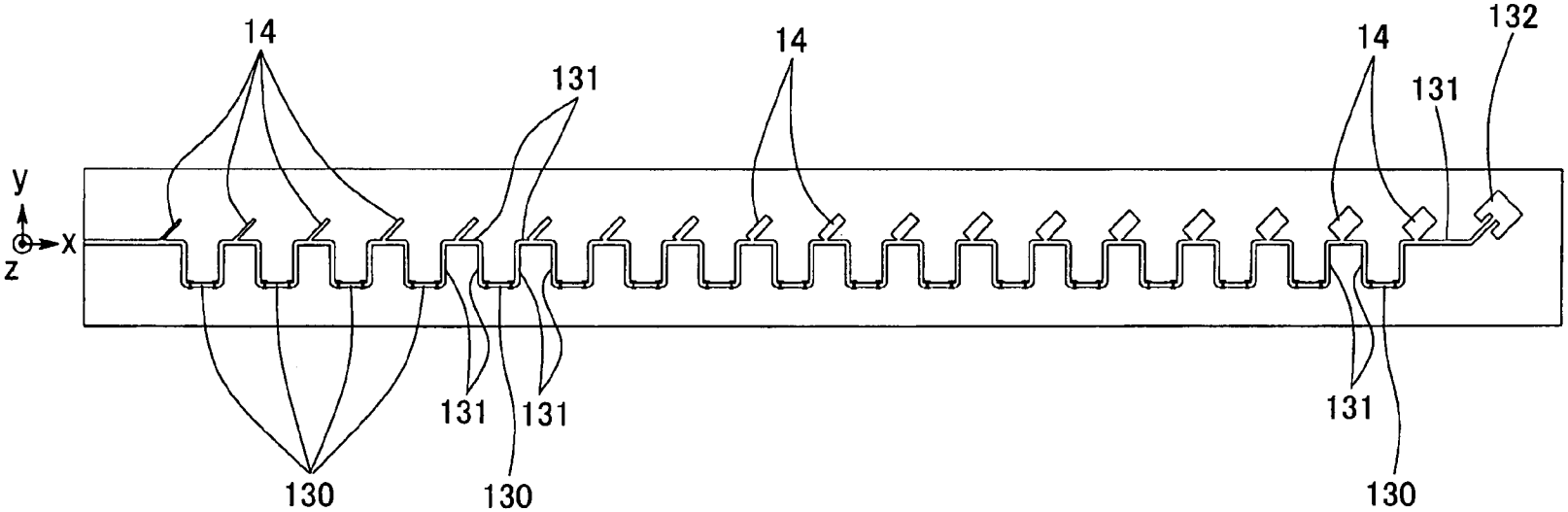
FIG. 3 is a diagram showing the planar pattern of a strip line 13 and antenna elements 14 of the antenna of the first embodiment.
Figure 4:
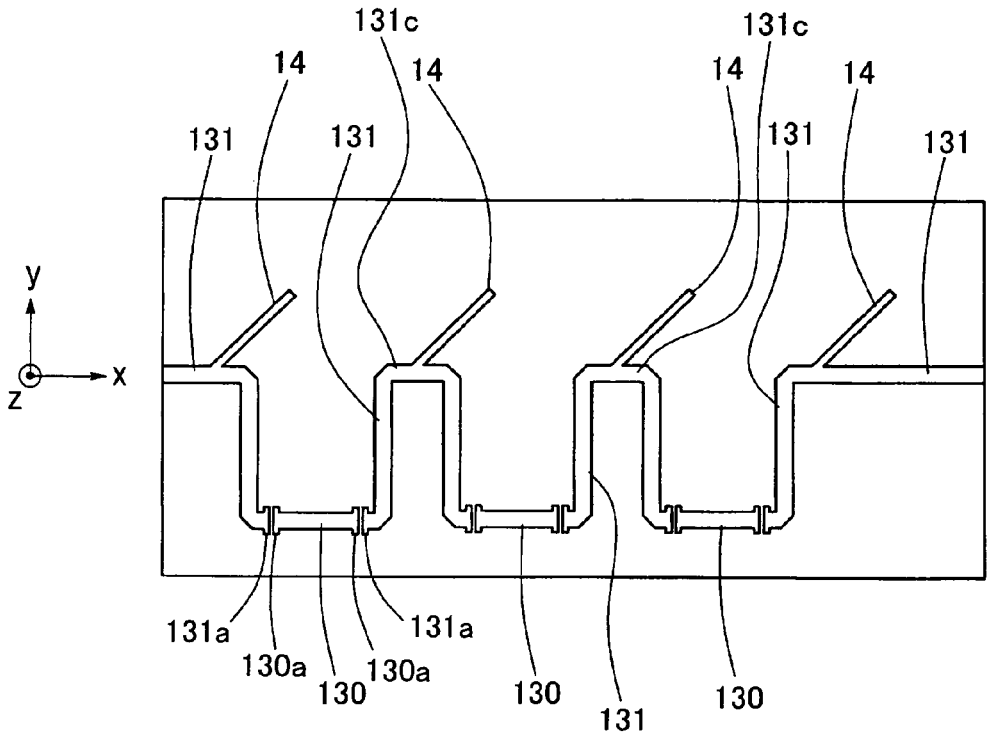
FIG. 4 is an enlarged view showing part of the planar pattern of the strip line 13 and the antenna elements 14.

FIG. 3 is a diagram showing a planar pattern of the strip line 13 and the antenna elements 14. FIG. 4 is an enlarged view showing a part of the planar pattern. The strip line 13 is constituted of first lines 130 serving as resonators, and second lines 131 to which the corresponding antenna elements 14 are connected. The first lines 130 and the second lines 131 are disposed alternately at predetermined intervals along one direction (along the x-direction in FIG. 3). Each antennal element 14 is connected to the center of a corresponding one of the second lines 131. The strip line 13 is connected with an antenna element 132 at its end to emit the remaining power.

Figure 5:
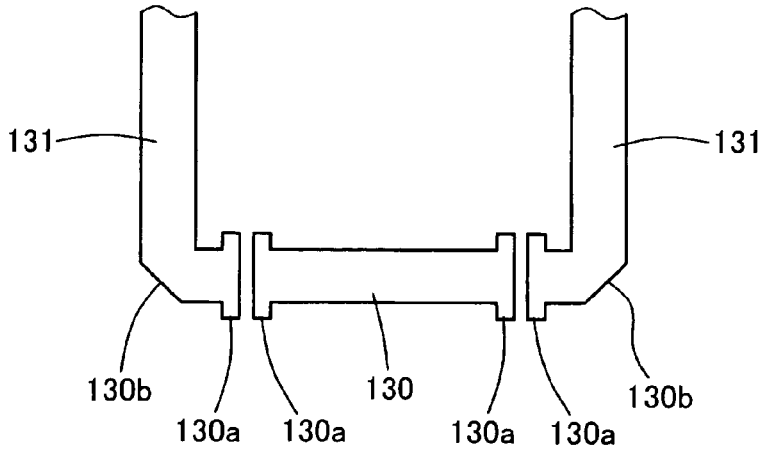
FIG. 5 is an enlarged view showing the vicinity of one of first lines 130 of the antenna of the first embodiment.

FIG. 5 is an enlarged view showing the vicinity of the first lines 130. As shown in FIGS. 4 and 5, the first lines 130 are straight lines, each extending in the x-direction between the adjacent second lines 131. Each of the first lines 130 has a length of $\lambda/2$ in the line direction, and serves as a $\lambda/2$ resonator. Each of the first lines 130 is widened at its ends 130*a* opposite to the adjacent second lines 131, so that it has a reduced size as a $\lambda/2$ resonator.

Each of the second lines 131 is bent at right angles at four places so as to have a convex shape of C. Each of the second lines 131 is also widened at its ends 131*a* opposite to the adjacent first lines 13. Each of the outer corners of the four bent portions 131*b* of the second line 131 is chamfered at 45 degrees with respect to the line direction in order to reduce reflection of electromagnetic waves at these bent portions.

The second lines 131 may have any length longer than or equal to $\lambda/2$, if the excitation phases of the antenna elements 14 are in phase with one another at center of the operating frequency of the antenna. If the length of the second lines 131 is shorter than $\lambda/2$, since the second lines 13 operate as resonators, and accordingly the resonance characteristics of the antennal elements 14 connected to the second lines 131 are changed significantly, the reflection-frequency characteristics and phase-frequency characteristics of the antennal elements 14 are changed significantly, disabling control of the excitation phase of the antenna. According to this embodiment, the length of each second lines 131 is set longer than or equal to $\lambda/2$, so it does not operate as a resonator. Accordingly, according to this embodiment, it is possible to control the characteristics of the antenna affected by the characteristics of the antenna elements 14, and the characteristics of the antenna affected by the first lines 130 serving as resonators individually. The characteristics of the antenna affected by the characteristics of the antenna elements 14 include the gain, direction of polarization and side lobe level of the antenna.

The antenna element 14 is a rectangular conductor of a length of approximately $\lambda/2$. The antenna element 14 is connected to a portion 131*c* (referred to as "antenna element coupling portion 131*c*" hereinafter) of the corresponding second line 131. The antenna element coupling portion 131*c* extends in the x-direction, and is not collinear with the first line 130. The longitudinal direction of each antenna element 14 is at an angle of 45 degrees with the x-direction, so that the direction of polarization of electromagnetic waves is at an angle of 45 degrees with the x-direction.

However, the longitudinal direction of each antenna element 14 with the x-direction may be set at an angle different from 45 degrees to achieve a required direction of polarization.

As shown in FIG. 3, the antenna elements 14 are shaped such that the widths of the antenna elements 14 become larger toward the end of the strip line 13. The intensity of emission of electromagnetic waves from the antenna element 14 increases with the increase of its width. By shaping the antenna elements 14 as above, it is possible to compensate variation of the emission intensity with respect to the distance from a feed point of the antenna.

The reason why the second line 131 is bent at four places is to reduce the interval of the antennal elements 14 shorter than or equal to $\lambda_0$. If the interval of the antennal elements 14 is longer than $\lambda_0$, since grating lobes are formed, it becomes difficult for the antenna to emit a desired directional beam. However, if the interval of the antennal elements 14 is too short, each adjacent two of the antennal elements 14 interact on each other. Accordingly, preferably, the interval is longer than or equal to $0.5\lambda_0$ and shorter than or equal to $\lambda_0$. More preferably, the interval is set within the range of $0.7\lambda_0$ to $0.95\lambda_0$.

As shown in FIG. 2, the second ground plate 12 is formed with a plurality of rectangular windows 15. The windows 15 are located at positions opposite to the corresponding antenna elements 14 in the z-direction. The long sides of the window 15 are parallel to the longitudinal direction of the antenna element 14. The short sides and long sides of the window 15 are perpendicular to each other. The windows 15 are provided for increasing the emission and reception efficiencies of the antenna elements 14. In the first embodiment, the windows 15 are formed in the second ground plate 12 in order to emit and receive electromagnetic waves from the side of the second ground plate 12. However, the windows 15 may be formed in the first ground plate 10, when it is required to emit and receive electromagnetic waves from the side of the first ground plate 10.

The sum of the lengths of the first lines 130 and the lengths of the second lines 131 is determined so that all the antenna elements 14 have the same feed phase at a design frequency. That is, the antenna of this embodiment is designed so that the beam direction is perpendicular to the first and second ground plates 10 and 12, that is, parallel to the z-direction.

If the frequency of the power supplied from a feed point (not shown) is shifted from a design frequency, there occurs variation in the feed phase among the antenna elements 14, causing the beam direction to change. In the antenna of this embodiment, since each first line 130 serves as a resonator, such a phase variation is increased, and accordingly the beam direction changes more widely. The extent of increase of the phase variation can be controlled by the capacitance formed by a gap between each first line 130 and each adjacent second line 131. That is, the extent of the phase variation can be controlled by the distance between each first line 130 and each second line 131, and the widths of the first and second lines 130 and 131 at their ends.

As explained above, according to the antenna of the first embodiment, the beam direction can be steered in a wider angle range by changing the frequency of the feed power (operating frequency) than the conventional array antennas as disclosed in Patent document 1.

Accordingly, when the antenna of the first embodiment is used for a millimeter wave radar of a vehicle, since the radar beam angle can be adjusted by adjusting the operating frequency of the antenna without manually adjusting the mounting angle of the radar, productivity of the vehicle can be improved.

Figure 6:
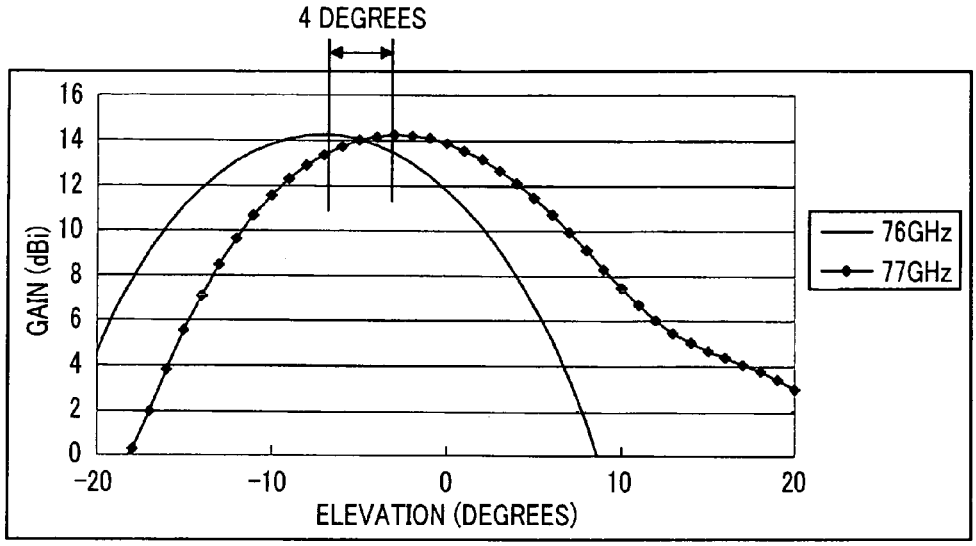
FIG. 6 is a graph showing a simulation result of the directivity of the antenna of the first embodiment.

FIG. 6 is a graph showing simulation results of the directivity in the z-x plane of the antenna of this embodiment when the operating frequency is 76 GHz, and when the operating frequency is 77 GHz. In this graph, the z-direction is a direction of 0 elevation angle. As seen from this graph, the beam direction changes by approximately four degrees by changing the operating frequency between 76 GHz and 77 GHz. Accordingly, in this embodiment, it is possible to change the beam direction by approximately four degrees by changing the operating frequency by 1 GHz within the frequency range between 76 GHz and 77 GHz.

Second Embodiment

Figure 7:
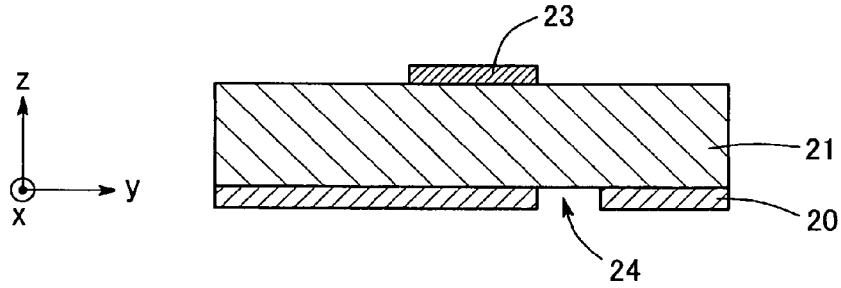
FIG. 7 is a cross-sectional view of an antenna according to a second embodiment of the invention.

FIG. 7 is a cross-sectional view of an antenna according to a second embodiment of the invention. The antenna of the second embodiment includes a first ground plate 20, a first dielectric substrate 21 formed on the first ground plate 20, and a microstrip line 23 made of a conductive material formed as a transmission line on the first dielectric substrate 21. Like the strip line 13 of the first embodiment shown in FIGS. 3 and 4, the microstrip line 23 of the second embodiment is constituted of first lines 230 and second lines 231 disposed alternately at predetermined intervals.

The first ground plate 20 is formed with a plurality of rectangular slots 24. The slots 24 are disposed at an angle of 45 degrees with the line direction (z-direction) of the microstrip line 23. The slots 24 are located at such positions that the slots 24 partially overlap corresponding antenna element coupling portions 231*c* of the second lines 231, which are parallel to the x-direction and not collinear with the first lines 230, when viewed from the z-direction perpendicular to the first ground plate 20. Each slot 24 is coupled to the corresponding second line 231 electromagnetically to operate as an antenna element.

According to the antenna of the second embodiment, like the antenna of the first embodiment, the beam angle can be steered in a wide angle range by changing the operating frequency because the first lines operates as resonators which increase the phase variation due to change of the operating frequency.

Third Embodiment

Figure 9:
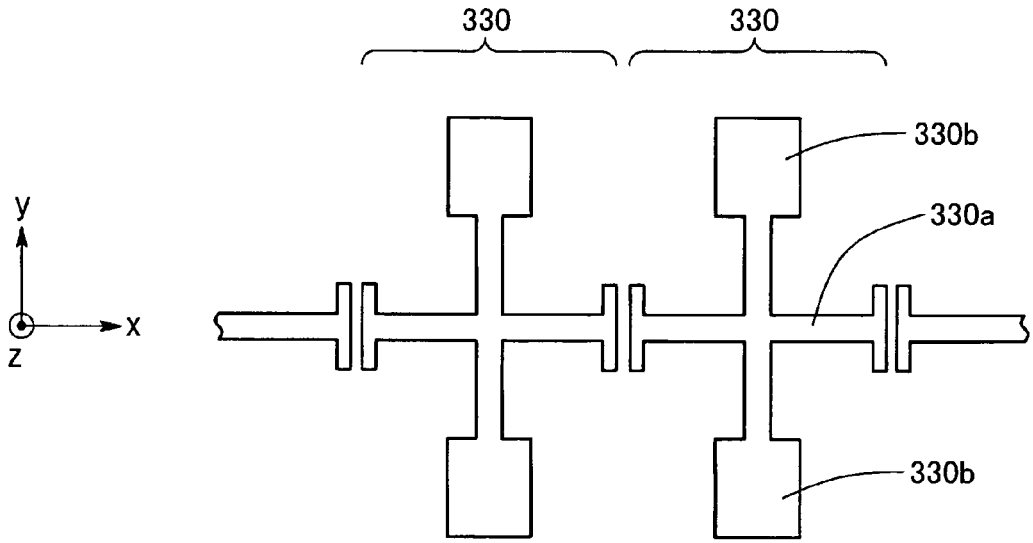
FIG. 9 is a plan view showing first lines 330 of an antenna according to a third embodiment of the invention.
Figure 10:
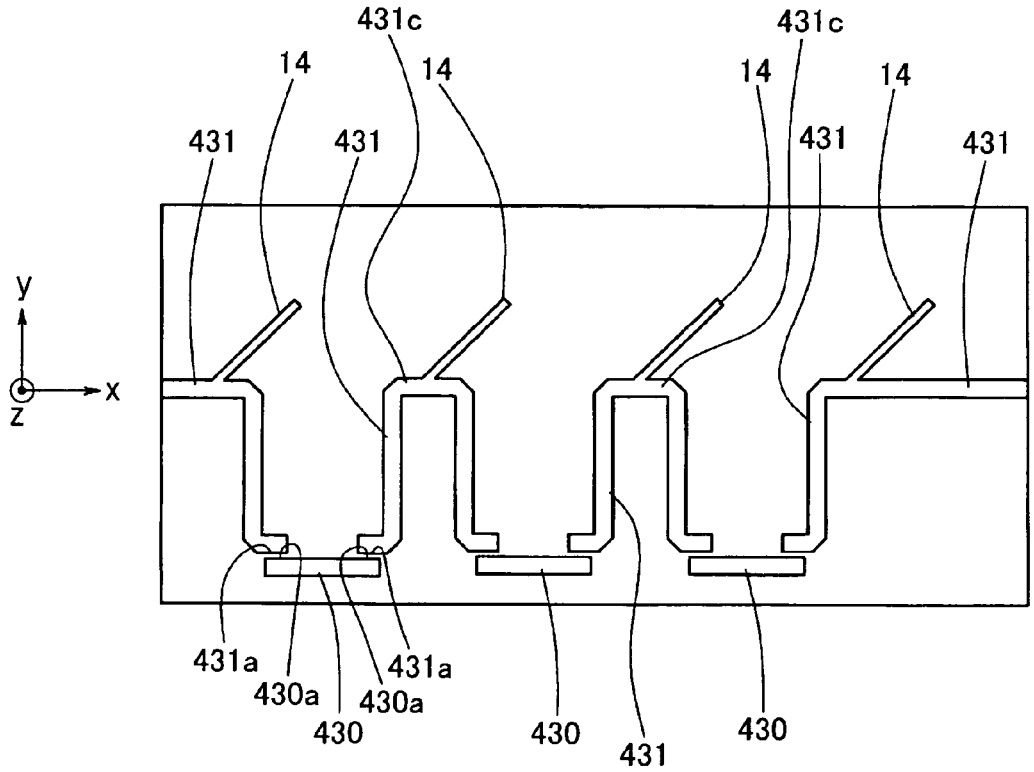
FIG. 10 is a plan view showing coupling sections between first lines and second lines of a modification of the antenna according to the first embodiment of the invention.

The antenna of a third embodiment of the invention differs from the antenna of the first embodiment in that each of the first lines 130 is replaced by a pair of first lines 330 disposed at a certain distance from each other. As shown in FIG. 9, each first line 330 is constituted of a straight line 330*a* and two stubs 330*b* provided in the center portion of the straight line 330*a* in a cross shape so as to be orthogonal to the line direction (x-direction). The stubs 330*b* serve as inductors, so that the physical length of the λ/2 resonator is reduced to approximately 0.25λ.

By the provision of the pair of the two first lines 330 serving as the λ/2 resonator, the phase variation among the antenna elements 14 can be increased more than in the first embodiment, to thereby further increase the beam scan range of the antenna.

The above configuration that each of the first lines 130 is replaced by the pair of the first lines 330 can be applied to the second embodiment.

Fourth Embodiment

Figure 11:
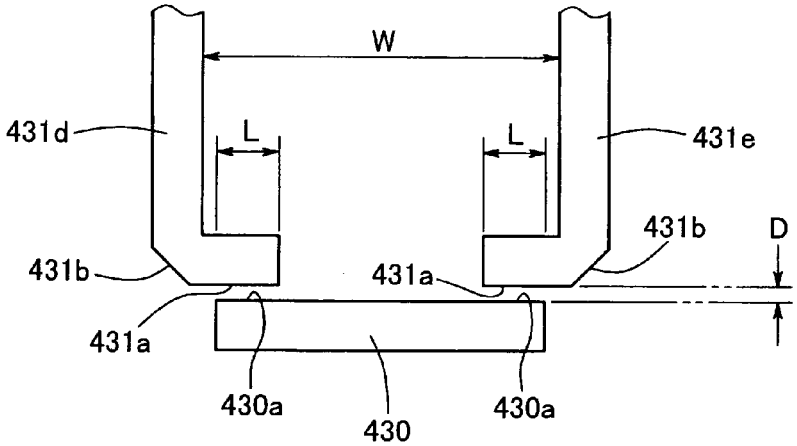
FIG. 11 is an enlarged view showing a coupling section of a first line and a second line of an antenna according to a fourth embodiment of the invention.
Figure 12:
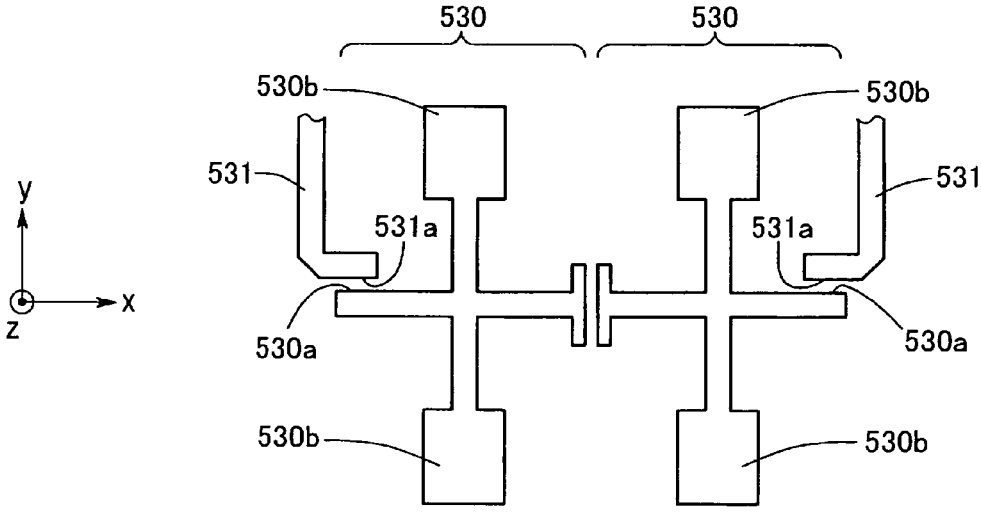
FIG. 12 is a plan view showing coupling sections between first lines and second lines of a modification of the antenna according to the third embodiment of the invention.

FIGS. 11 and 12 show an antenna according to a fourth embodiment of the invention. In FIGS. 11 and 12, the same reference numerals or characters as those in the previously described figures indicate the same or corresponding elements or portions. The fourth embodiment differs from the first embodiment in the structure for electromagnetic coupling between the first and second lines. In this embodiment, the first line 430 is a straight line having a length of half the guide wavelength in the direction of propagation of signal or electrical power (the x-direction). Unlike the first embodiment, the width of the first line 430 is not increased at its ends. Like the first embodiment, the second line 431 is bent at right angles at four places to have a shape of a letter C. Unlike the first embodiment, the width of the second line 431 is not increased at its ends. The first line 430 includes side edge portions 430*a* extending in the x-direction. The second line 431 includes side edge portions 431*a* extending in the x-direction. The side edge portions 430 face the corresponding side edge portions 431*a* with a certain gap therebetween. The facing length L of the side edge portions 430*a* and 431*a* and the gap D between the side edge portions 430*a* and 431*a* are determined in accordance with required coupling capacitance and inductance. The facing length L is larger than the width of the first and second lines.

According to the fourth embodiment, since the first line 430 and the second line 431 are electromagnetically coupled with each other at their side end portions 430*a* and 431*a*, the distance W between rising portions 431*d* and 431*e* of the second lines 431 which are located on both sides of the first line 430 can be made shorter than the first embodiment. Accordingly, the length of the antenna of this embodiment can be made short compared to the first embodiment. Further, since the facing length L of the side end portions 430*a* and 430*b* is longer than the width of the first and second lines, product-to-product variation in the gap D and the facing length L can be made sufficiently small. Accordingly, product-to-product variation in the antenna beam directivity with respect to the operating frequency can be made smaller than the first embodiment. In this embodiment, the adjacent antenna elements 14 are connected to each other through the antennal element coupling portion like in the first embodiment. The antenna of this embodiment includes the first ground plate 10, first dielectric substrate 11*a*, second dielectric substrate 11*b*, second ground plate 12 and windows 15 as in, the case of the first embodiment. The configuration of this embodiment described above can be applied to the structure of the second embodiment shown in FIG. 7, and the structure of the third embodiment shown in FIG. 9. FIG. 12 shows the case of this configuration being applied to the structure of the third embodiment show in FIG. 9. As shown in FIG. 12, this case has such a structure that side edge portions 531*a* of two second lines 531 are located opposite to side edge portions 530*a* of two first lines 530 coupled to each other with a certain distance therebetween.

Fifth Embodiment

Figure 13:
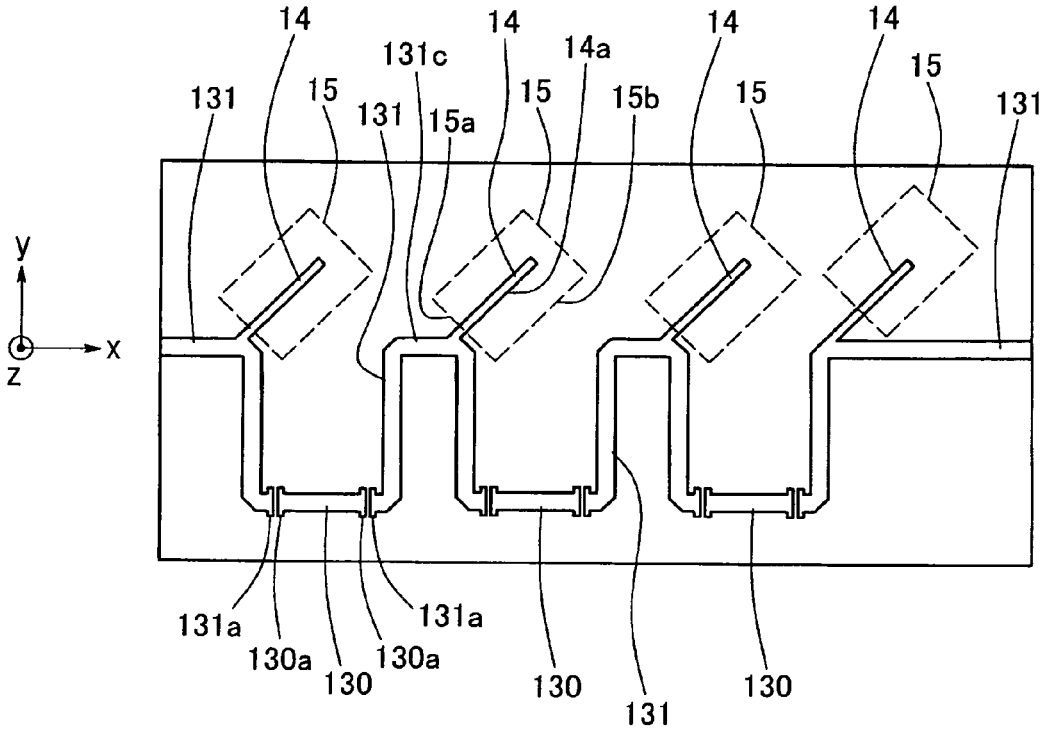
FIG. 13 is a diagram showing coupling positions between second lines and antenna elements of an antenna according to a fifth embodiment of the invention.

Next, an antenna according to a fifth embodiment of the invention is described with reference to FIG. 13. In the first embodiment, the antenna element 14 is connected to the center of the second line 131 with respect to the direction of propagation of signal or electrical power (the x-direction). In the fifth embodiment, the connection point between the antenna element 14 and the second line 131 is shifted from the center of the second line 131. That is, in this embodiment, each of the antenna elements 14 is connected to the corresponding second line 131 at a position distant from the center of the antenna element coupling portion 131*c* in the length direction. According to this configuration, since the emission intensity from each antenna element 14 can be reduced so that the emission distribution is uniform in the direction of length of the antenna.

The window 15 is formed in a shape of a rectangle having long sides 15*a* parallel to the long sides 14*a* of the antenna element 14 of an oblong card shape. The antenna element 14 extends in parallel with the long sides 15*a* of the window 15, passing the center of one of the short sides 15*b*. The window 15 is located to such a position with respect to the antenna element coupling portion 131*c* that the second line 131 is not present beneath the window 15. By this configuration, it is possible to reduce the cross polarization caused by the openings of the windows 15.

Figure 8:
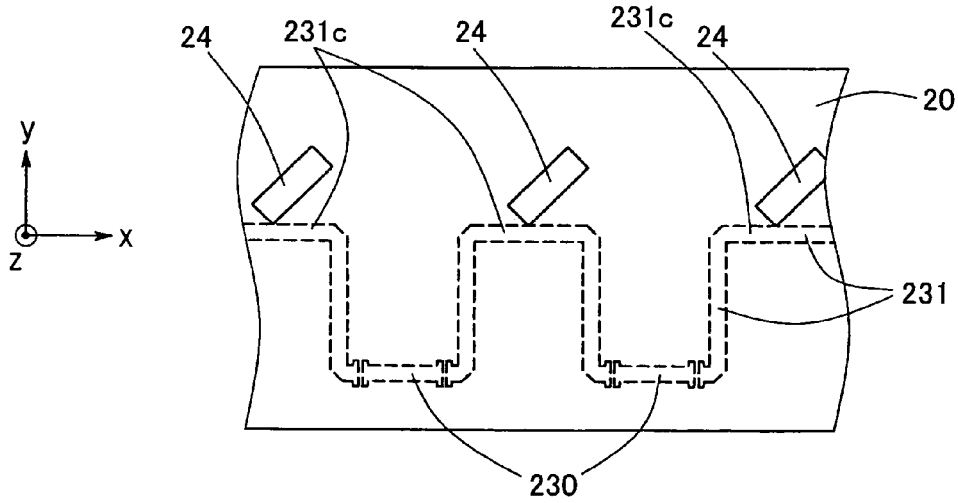
FIG. 8 is a plan view showing a first ground plate 20 of the antenna of the second embodiment.

The above described configuration that each of the antenna elements 14 is connected to the corresponding second line at a position distant from the center of the antenna element coupling portion 131*c* with respect to the length direction can be applied to the second and third embodiments. In the case of this configuration being applied to the second embodiment, the position of electromagnetic coupling between the slot 24 and the second line 231 shown in FIG. 8 is shifted from the center of the antenna element coupling portion 231*c* of the second line 231 with respect to the direction of propagation of signal or electrical power (the x-direction). The amount of shift is set in order that the emission intensity of electromagnetic waves from the slot 24 becomes a desired value.

The above described configuration that the window 15 is located to such a position with respect to the antenna element coupling portion 131*c* that the second line 131 is not present beneath the window 15 can be applied to the third embodiment.

Other Embodiments

Figure 14:
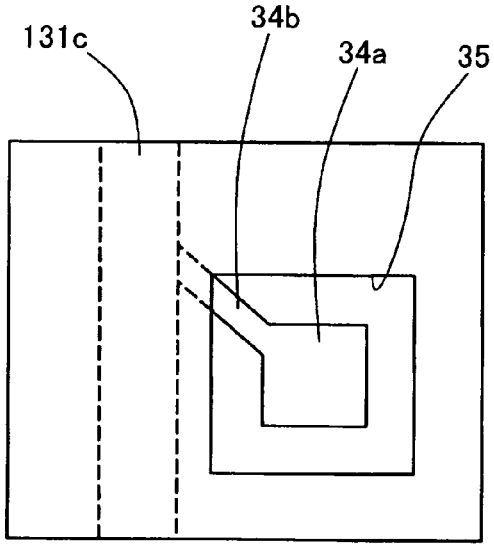
FIG. 14 is a plan view of an antennal element of a modification of the first embodiment.

The first embodiment may be modified such that, instead of a rectangular conductor of a length of λ/2, a rectangular slot formed in the first ground plate 10 or second ground plate 12 may be used as the antenna element 14 like in the second embodiment. In this case, it is not necessary to form the windows 15 in the second ground plate 12. Further, as shown in FIG. 14, a feed line 34*b* connecting a patch antenna 34 made of a square conductor having a side length of approximately λ/2 and the antenna element coupling portion 131*c* of the second line 131 may be used as the antenna element 14. In this case, the polarization direction can be controlled in accordance with the direction of the feed line 34*b*. Also by such a configuration, it is possible to increase the emission and reception effencies of electromagnetic waves by forming the windows 35 in the second ground plate 12.

The second embodiment may be modified such that, instead of the slots 24 formed in the first ground plate 20, rectangular conductors of a length of λ/2 respectively connected to the second lines 231 may be used as the antenna elements like in the first embodiment. Further, the patch antenna 34*a* and the feed line 34*b* as shown in FIG. 14 may be used as the antenna element.

In the first to fifth embodiments described above, the electrical length of the first line is λ/2. However, if the electrical length of the first line is (2n−1)·λ/2 (n being an integer larger than 1), the first line can operate as a resonator.

The above explained preferred embodiments are exemplary of the invention of the present application which is described solely by the claims appended below. It should be understood that modifications of the preferred embodiments may be made as would occur to one of skill in the art.

What is claimed is:

1. An antenna comprising:

a first ground plate;

a first dielectric substrate formed on the first ground plate;

a transmission line made of a conductive material formed on the first dielectric substrate; and a plurality of antenna elements electromagnetically coupled to the transmission line;

wherein the transmission line is constituted of at least one first line serving as a resonator having a resonator length equal to (2n−1)/2 times (n being a positive integer) a guide wavelength of the transmission line and a plurality of second lines each having an electrical length longer than half the guide wavelength, the first and second lines being disposed alternately at predetermined intervals, and each of the antenna elements is electromagnetically coupled to a corresponding one of the second lines.

2. The antenna according to claim 1, wherein side edge portions of adjacent two of the second lines are opposite to a side edge portion of the first line located between the adjacent two of the second lines with a certain gap therebetween at both ends of the first line in a length direction of the first line.

3. The antenna according to claim 1, wherein the plurality of the antennal elements are disposed at intervals smaller than or equal to a free space wavelength at an operating frequency of the antenna.

4. The antenna according to claim 3, wherein each of the second lines is bent at four places to have a convex shape of a letter C.

5. The antenna according to claim 1, wherein each of the first and second lines has a width increased at both ends thereof.

6. The antenna according to claim 1, wherein the first line is provided with a pair of stubs.

7. The antenna according to claim 1, wherein each of the antenna elements is made of a rectangular conductor integrally connected to a corresponding one of the second lines.

8. The antenna according to claim 1, wherein each of the antenna elements is a patch antenna made of a square conductor connected to a corresponding one of the second lines through a feed line made of a conductor.

9. The antenna according to claim 1, further comprising a second dielectric substrate formed on the transmission line and the first dielectric substrata, and a second ground plate formed on the second dielectric substrate.

10. The antenna according to claim 9, wherein one of the first and second ground plates is formed with windows at positions respectively opposite to the antenna elements in a direction perpendicular to the first or second ground plate.

11. The antenna according to claim 1, wherein each of the antenna elements is electromagnetically coupled to a corresponding one of the second lines at a position shifted from a center of the corresponding second line in a direction of propagation of signal or electrical power of the corresponding second line.

12. The antenna according to claim 1, wherein each of the antenna elements is a rectangular slot formed in the first ground plate.

13. The antenna according to claim 1, further comprising a second dielectric substrate formed on the transmission line and the first dielectric substrate, and a second ground plate formed on the second dielectric substrate, each of the antenna elements being a rectangular slot formed in one of the first ground plate and the second ground plate.

14. The antenna according to claim 10, wherein each of the windows is formed at a position beneath which none of the second lines is present.

* * * * *